US009758296B2

(12) United States Patent
Giordano et al.

(10) Patent No.: US 9,758,296 B2
(45) Date of Patent: Sep. 12, 2017

(54) SYSTEM AND METHOD FOR DISPENSING AEROSOL FOAM

(71) Applicant: Draco Sound, Corp., Canton, MA (US)

(72) Inventors: Charles Giordano, Canton, MA (US); David Swett, Waltham, MA (US)

(73) Assignee: Draco Sound, Corp., Canton, MA (US)

( * ) Notice: Subject to any disclaimer, the term of this patent is extended or adjusted under 35 U.S.C. 154(b) by 0 days.

(21) Appl. No.: 14/723,777

(22) Filed: May 28, 2015

(65) Prior Publication Data

US 2016/0347533 A1 Dec. 1, 2016

(51) Int. Cl.

| | |
|---|---|
| ***B65D 83/14*** | (2006.01) |
| ***B65D 83/54*** | (2006.01) |
| ***A45D 27/10*** | (2006.01) |
| ***B65D 83/52*** | (2006.01) |
| ***B65D 83/20*** | (2006.01) |

(52) U.S. Cl.

CPC ..... *B65D 83/54* (2013.01); *A45D 27/10* (2013.01); *B65D 83/206* (2013.01); *B65D 83/525* (2013.01); *B65D 83/546* (2013.01)

(58) Field of Classification Search

CPC .... B65D 83/54; B65D 83/201; B65D 83/546; B65D 83/525; A61M 15/0066

USPC ..... 222/425, 402.2, 627.5, 354, 355, 438, 222/305, 402.1–402.25, 239, 182, 222/206–209, 335, 309; 137/627.5

See application file for complete search history.

(56) References Cited

U.S. PATENT DOCUMENTS

| | | | | |
|---|---|---|---|---|
| 3,138,301 | A * | 6/1964 | Ward | B65D 7/40 222/335 |
| 3,221,946 | A * | 12/1965 | Riley | B65D 83/44 222/309 |
| 3,231,150 | A * | 1/1966 | Holm | B65D 83/546 222/288 |
| 3,377,004 | A | 4/1968 | Kjelson | |
| 3,858,771 | A * | 1/1975 | Bret | B65D 83/546 222/402.2 |
| 4,161,264 | A * | 7/1979 | Malmgren | A61M 1/1656 222/135 |
| 4,809,888 | A * | 3/1989 | Suck | B65D 83/546 137/625.68 |
| 5,137,175 | A | 8/1992 | Kowalski et al. | |
| 5,501,375 | A | 3/1996 | Nilson | |
| 5,588,565 | A | 12/1996 | Miller | |
| 6,273,304 | B1 * | 8/2001 | Hoshino | B65D 83/54 222/402.2 |
| 6,866,038 | B2 * | 3/2005 | Bacon | F16K 7/068 128/200.14 |
| 7,699,192 | B2 * | 4/2010 | Dunne | G01F 11/28 222/153.11 |
| 2010/0006601 | A1 | 1/2010 | De Man et al. | |

OTHER PUBLICATIONS

International Search Report and Written Opinion mailed Jul. 29, 2016 in corresponding PCT/US16/28098.

Office Action mailed Oct. 6, 2016 in corresponding U.S. Appl. No. 15/131,636.

* cited by examiner

*Primary Examiner* — Charles P Cheyney

(74) *Attorney, Agent, or Firm* — Grossman, Tucker, Perreault & Pfleger, PLLC

(57) ABSTRACT

A system and method for dispensing a metered amount of aerosol foam from a pressurized aerosol canister is provided.

14 Claims, 5 Drawing Sheets

SYSTEM AND METHOD FOR DISPENSING AEROSOL FOAM

FIELD OF THE INVENTION

The present invention relates to a system and method for dispensing aerosol foam from a pressurized aerosol canister. More specifically, it relates to a system and method for dispensing a metered amount of aerosol foam.

BACKGROUND OF THE INVENTION

Aerosol canisters that dispense aerosol foams, such as shaving foam, are known in the art. Typically, shaving foam is dispensed from a pressurized vessel containing the active components of the foam such as soap, oils, surfactants and water, and a hydrocarbon propellant such as propane, butane, isobutene or a mixture thereof. The expelling of the fluid mixture through a dispensing valve and expansion nozzle to atmospheric pressure allows the propellant portion of the dispensed mixture to expand into gas and create foam.

The traditional dispensing system for such an aerosol canister is a normally-closed, push-to-open, release-to-close valve. The user interaction with this valve is inexact, and the system depends on the user to meter and dispense the amount of foam by manually opening the valve until the desired amount of foam is dispensed and then releasing the valve. To add to the imprecision of the dispensed amount of foam, the volume of the foam changes during and after expulsion, making the process of judging "visually" the amount of foam dispensed difficult during the user's interaction with the valve. If the user holds the valve open too long and dispenses too much foam, he is left with the choice of whether to apply all of it too thickly to his face or to separate and discard the excess.

The quality of a shave depends on using the correct amount of shaving foam, as too little does not provide suitable lift of the hairs and lubrication for the razor, and too much can float the blade of the razor or clog a multi-blade razor. The current state of shaving foam dispensing systems is too inexact and user-dependent to provide a metered amount of shaving foam and leads to poor shaves and waste of foam.

SUMMARY OF THE INVENTION

In a preferred embodiment of the present invention, a system is provided to seal a first end of an elastic tube to an aerosol canisters dispense valve and to activate the valve through an application of user force. The second end of the elastic tube is connected to a release valve that communicates fluidically between the elastic tube and an expansion nozzle that is open to the outside environment. There is also provided a confined space to contain the elastic tube, the volume of which confined space can be adjusted to set the maximum displacement of the elastic tube, thereby setting the maximum amount of aerosol foam contained in the elastic tube.

A rigid structure detachably affixed to the aerosol canister holds the first end of the elastic tube to the dispense valve of an aerosol canister. The elastic tube is enclosed by a confined space of adjustable volume. The second end of the elastic tube is affixed to a release valve composed of a pinch bar bearing transversely on the elastic tube wall against an anvil.

During operation, a user activates a trigger, which pivots against the rigid structure and bears upon the pinch bar. The subsequent loading of the pinch bar against the elastic tube and the anvil seals the release valve shut, and simultaneously opens the dispense valve on the aerosol canister releasing aerosol foam into the elastic tube until the pressure in the elastic tube is the same as the pressure in the aerosol canister. After the elastic tube expands to fill the confined space, the user releases the trigger, closing the dispense valve on the aerosol canister and opening the release valve. The elastic tube then contracts expelling the foam through the expansion nozzle until the pressure in the elastic tube returns to atmospheric pressure.

These aspects of the invention are not meant to be exclusive and other features, aspects, and advantages of the present invention will be readily apparent to those of ordinary skill in the art when read in conjunction with the following description, appended claims, and accompanying drawings.

BRIEF DESCRIPTION OF THE DRAWINGS

The foregoing and other objects, features, and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

A system and method for dispensing, metered amounts of aerosol foam from a pressurized aerosol canister is provided. This dispensing system comprises a detachable seal to the canister, an elastic tube, a means to adjust the capacity of the elastic tube, a release valve, and an expansion nozzle. The detachable seal allows the system to be exchanged among multiple aerosol canisters as the aerosol foam in each canister is depleted.

Referring, to FIGS. 1-7 in which like reference numbers refer to like elements, there is shown a preferred, embodiment of the dispensing system 40 of the present invention.

Figure 1:
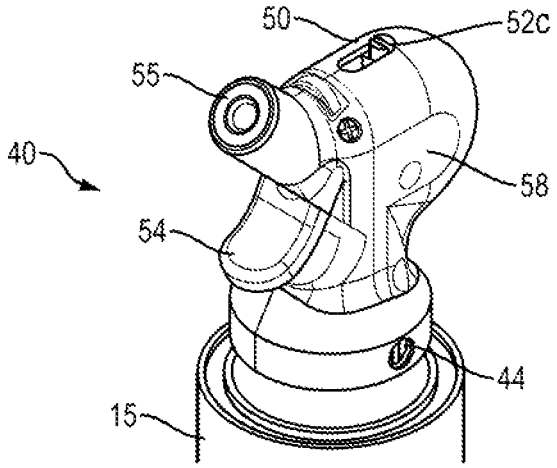
FIG. 1 is a front perspective view of a preferred embodiment of the dispensing system of the present invention installed on a typical aerosol canister.
Figure 2:
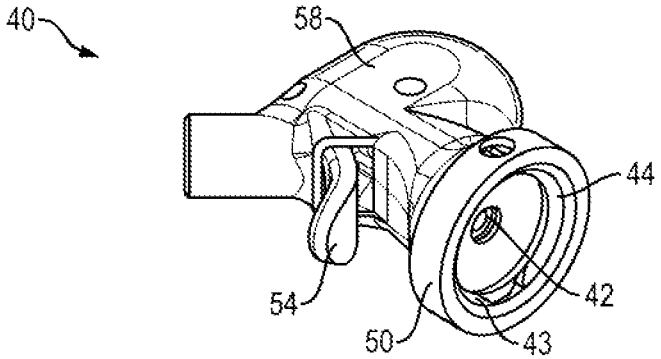
FIG. 2 is a bottom perspective view of a preferred embodiment of the dispensing system of the present invention.
Figure 3:
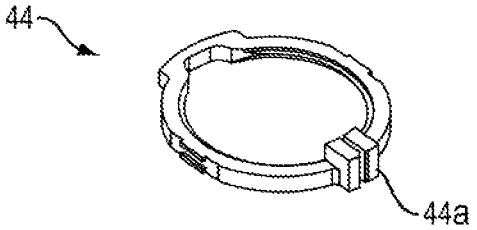
FIG. 3 is a detailed view of the valve activator ring of dispensing system of the present invention.
Figure 4:
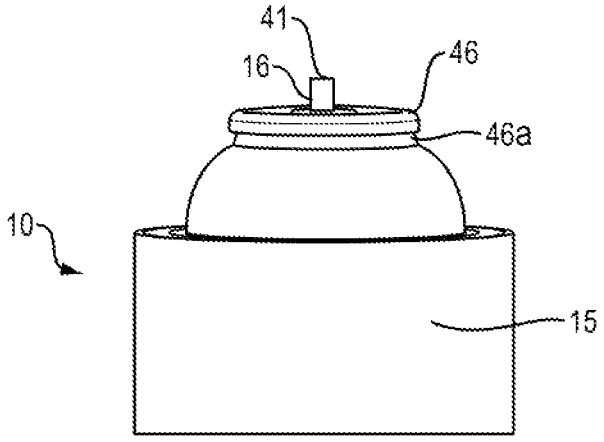
FIG. 4 is a side perspective view of a typical aerosol canister with which the dispensing system of the present invention can be used.

In one preferred embodiment, the dispensing system 40, as shown in FIGS. 1 and 2, seals to the nipple 41 of a valve 16 on a standard aerosol canister 10, as shown in FIG. 4. It seals fluidically with an elastic circumferential seal 42 on the dispensing system 40. A mounting collar 43 centers the dispensing system 40 to the valve crimp ring 46 of the aerosol canister 10, and an expandable locking ring 44 expands over the valve crimp ring 46 and contracts underneath to lock underneath the valve crimp ring undercut 46*a*, affixing the dispensing system 40 to the aerosol canister 10. By inserting a wedge into the expandable locking ring gap 44*a*, as shown in FIG. 3, the expandable locking ring 44 can be expanded to pass over the valve crimp ring undercut 46*a* and release the dispensing system 40 from the aerosol canister 10.

Figure 5:
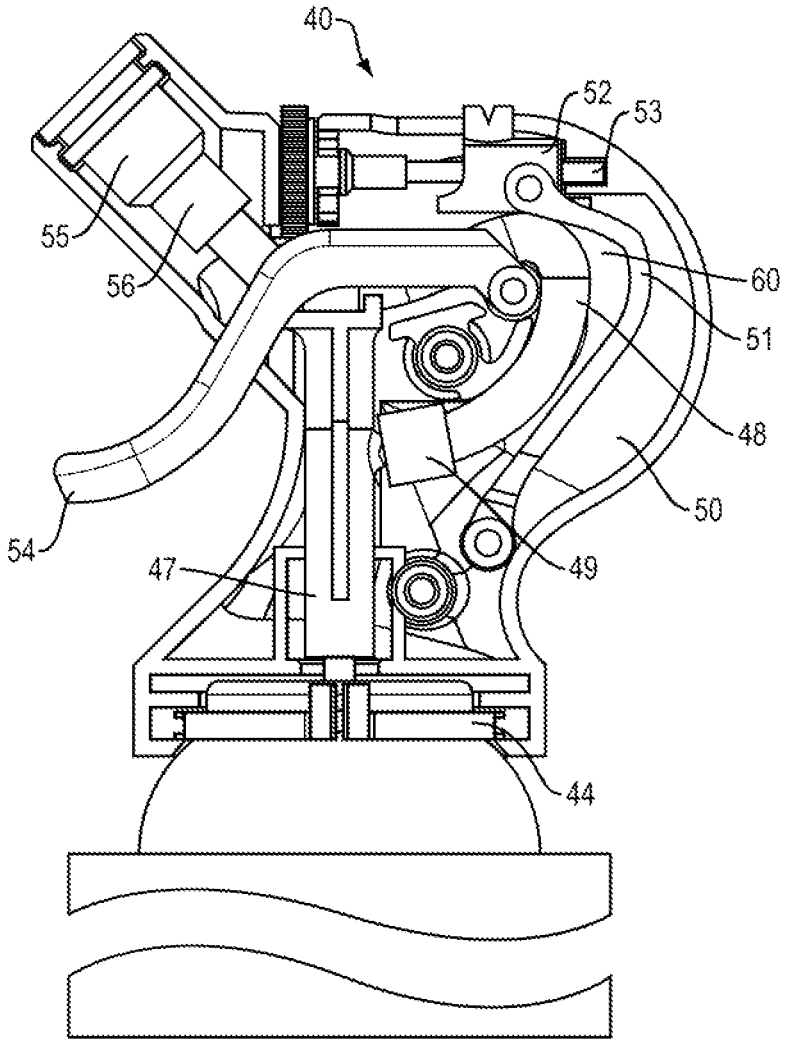
FIG. 5 is a front perspective view of an embodiment of the dispensing system of the present invention with the left cover removed.
Figure 6:
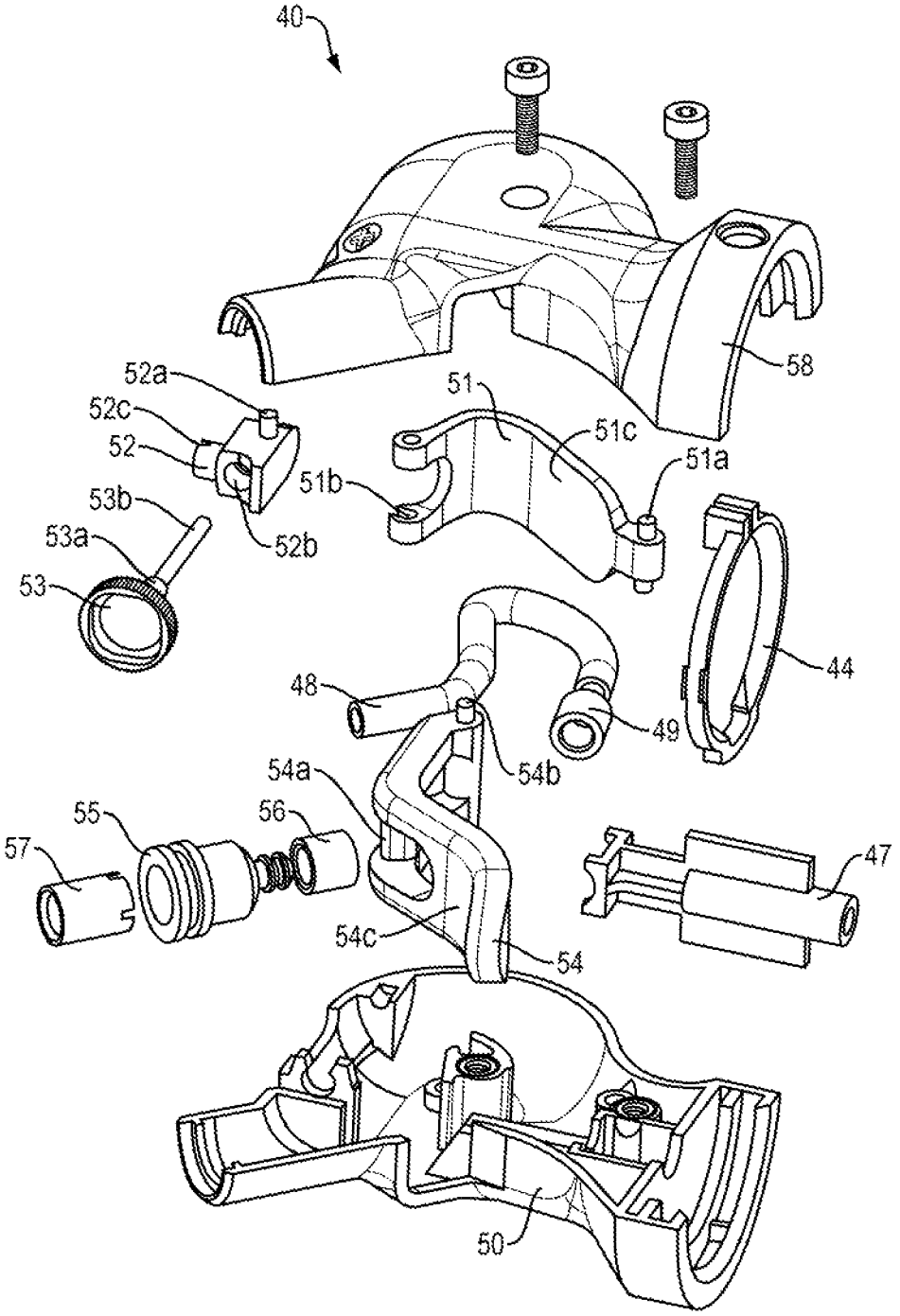
FIG. 6 is an exploded front perspective view of an embodiment of the dispensing system of the present invention.
Figure 7:
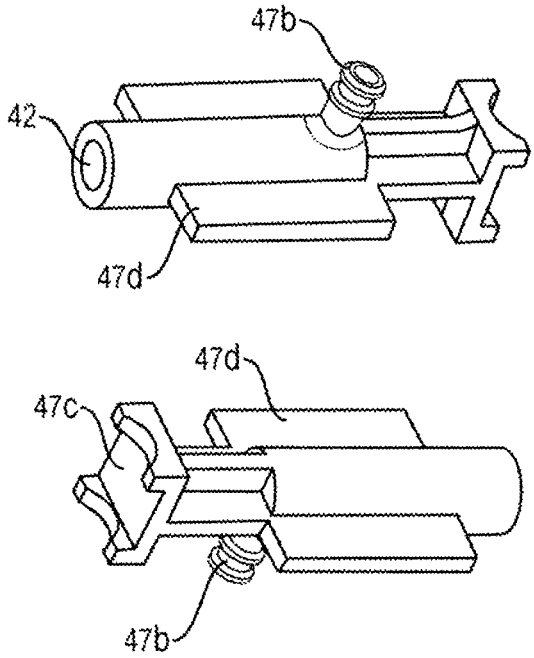
FIG. 7 is a detailed, view of the valve actuator of the dispensing system of the present invention.

As shown in FIGS. 5 and 6, the nipple 41 of the aerosol canister valve 16 is fluidically connected to an elastic tube 48 via the valve actuator 47. Specifically, the elastic tube 48 is sealed fluidically to the valve actuator nipple 47*b* by the compression fit caused by a tube sealing nut 49. The elastic tube 48 is routed between a right housing shoe 50 and an adjustable volume stop 51. The elastic tube 48 then passes between a trigger seal 54*a* and a valve actuator anvil 47*c*, as shown in FIG. 7 on the valve actuator 47. The elastic tube 48 is then connected to an expansion nozzle 55 by the compression fit caused by a nozzle sealing nut 56.

Again, as shown in FIG. 7, the valve actuator has valve actuator slide ribs 47*d*. The valve actuator 47 is constrained by the valve actuator slide ribs 47*d* to move axially relative to the nipple 41 of the aerosol canister valve 16 by slide ribs on the right housing 50 and the left housing 58. Axial force imparted to the valve actuator 47 is transmitted to the aerosol canister valve 16 by the bearing of a valve actuator shoulder 42 on the nipple 41 of the aerosol canister valve 16. Axial force is imparted to the valve actuator 47 by a trigger 54 constrained to rotate about the trigger pivot 54*b* relative to the right housing 50 and the left housing 58.

The elastic tube 48 is contained in a confined space 60, the volume of which can be adjusted with an adjustable volume stop 51, which is constrained to rotate relative to the right housing 50 and the left housing 58 about a stop pivot 51*a*. The position of the adjustable volume stop 51 is set by a volume stop yoke 53*b* on the volume adjustment screw 53, which volume stop yoke 53*b* is pinned to the adjustment nut drive pin 52*a*. The rotation of the volume adjustment screw 53 relative to the right housing 50 and the left housing 58 drives a volume adjustment nut 52 axially along a volume adjustment screw shaft 53*d* of the volume adjustment screw 53 and sets the position of the adjustable volume stop 51.

To dispense aerosol foam, a user depresses a trigger 54 by pushing on a trigger finger pad 54*c*. This causes the trigger 54 to rotate about a trigger pivot 54*b*, pushing a trigger seal 54*a* against the elastic tube 48, and pinching the elastic tube 48 against the valve actuator anvil 47*c*. The pinching of the elastic tube 48 creates a seal, closing the tube. The three transmitted to the valve actuator anvil 47*c* causes the valve actuator to bear upon the nipple 41 of the aerosol canister valve 16, opening the valve 16 and dispensing pressurized aerosol. The aerosol travels into the elastic tube 48 and expands the elastic tube until the pressure in the elastic tube 48 and the aerosol canister 10 are equalized. The final volume of the expanded elastic tube 48 is determined by the position of the adjustable volume stop 51 in the confined space 60.

The user then releases the trigger 54, closing the aerosol canister valve 16 and releasing the pinched elastic tube 48 and opening the tube 48 to atmospheric pressure. The opening of the tube 48 to atmospheric pressure allows the elastic tube 48 to contract, releasing the aerosol foam through an expansion nozzle 55. Additionally, the return of the elastic tube 48 to its initial position also restores the initial position of the trigger 54.

A user may change the metered amount of aerosol foam to be dispensed by the dispensing system 40 by the rotation of a volume adjustment screw knob 53*a*, which moves the adjustable volume stop 51 and sets the final volume of the confined space 60 containing the elastic tube 48. The user can view the setting of the adjustable volume stop 51 via the position of a volume indicator notch 52*c* relative to the right housing 50 and the left housing 58.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A dispensing system for dispensing a metered amount a pressurized canister, said system comprising:

a housing configured to be coupled to said pressurized canister, said housing comprising a nozzle;

an elastic tube comprising a first end configured to be fluidly coupled to a dispense valve of said pressurized canister and a second, generally opposite end configured to be fluidly coupled to said nozzle, wherein at least a first portion of said elastic tube extends through a confined space disposed within said housing;

an adjustable volume stop movably disposed at least partially within said housing and defining a portion of said confined space, wherein a position of said adjustable volume stop is user selectable to adjust a volume of said confined space; and a trigger coupled to said housing, wherein:

movement of said trigger in a first direction relative to said housing causes said first portion of said elastic tube to be sealed from said nozzle and opens said dispense valve such that said first portion of said elastic tube within said confined space expands until a pressure within said first portion of said elastic tube approximately equalizes with a pressure within said pressurized canister; and movement of said trigger in a second direction relative to said housing causes said dispense valve to close and fluidly couples said first portion of said elastic tube to said nozzle such that said expanded elastic tube contracts and dispenses said metered amount through said nozzle until said pressure in said elastic tube is approximately equal to atmospheric pressure.

2. The dispensing system of claim 1, wherein movement of said trigger in said first direction causes said first portion of said elastic tube to be sealed from said nozzle prior to opening said dispense valve.

3. The dispensing system of claim 1, wherein movement of said trigger in said second direction causes said dispense valve to close prior to fluidly coupling said first portion of said elastic tube to said nozzle.

4. The dispensing system of claim 1, further comprising a volume adjustment screw knob, wherein rotation of said volume adjustment screw knob is configured to cause said position of said adjustable volume stop to be user selectable to adjust said volume of said confined space.

5. The dispensing system of claim 4, further comprising a volume indicator configured to indicate said volume of said confined space.

6. The dispensing system of claim 1, wherein said housing is configured to be removably coupled to said pressurized canister.

7. The dispensing system of claim 1, further comprising said pressurized canister.

8. The dispensing system of claim 1, further comprising a valve actuator fluidly coupled to said first end of said elastic tube, said valve actuator configured to selectively actuate said dispense valve of said pressurized canister.

9. A method for dispensing from a pressurized canister comprising:

moving a user adjustable volume stop from a first position to a second position to adjust a volume of a confined space disposed within a housing and including a first portion of an elastic tube disposed within said confined space, wherein said elastic tube further comprises a first end configured to be fluidly coupled to a dispense valve of said pressurize canister and a second, opposite end configured to be fluidly coupled to a nozzle of said housing;

moving a trigger in a first direction relative to said housing to seal said first portion of said elastic tube disposed within said confined space from said nozzle and to open said dispense valve of said pressurized canister such that said first portion of said elastic tube within said confined space is fluidly coupled to said pressurized canister and expands until a pressure within said first portion of said elastic tube approximately equalizes with a pressure within said pressurized canister; and moving said trigger in a second direction relative to said housing to close said dispense valve and fluidly couple said first portion of said elastic tube to said nozzle such that said expanded elastic tube contracts until said pressure in said elastic tube is approximately equal to atmospheric pressure.

10. The method of claim 9, wherein moving said trigger in said first direction seals said first portion of said elastic tube from said nozzle prior to opening said dispense valve.

11. The method of claim 9, wherein moving said trigger in said second direction closes said dispense valve prior to fluidly coupling said first portion of said elastic tube to said nozzle.

12. The method of claim 9, further comprising rotating a volume adjustment screw knob to cause said adjustable volume stop to move from said first position to said second position.

13. The method of claim 12, wherein rotating said volume adjustment screw knob moves a volume indicator configured to indicate said volume of said confined space.

14. The method of claim 9, further comprising removably coupling said housing to said pressurized canister.

* * * * *